US005964342A

United States Patent [19]

Wecke et al.

[11] Patent Number: 5,964,342

[45] Date of Patent: Oct. 12, 1999

[54] SAFETY SWITCH

[75] Inventors: Rolf Wecke, Bückeburg; Roland Mönnings, Porta Westfalica, both of Germany

[73] Assignee: Hans Bernstein Spezialfabrik fur Schaltkontakte GmbH & Co., Germany

[21] Appl. No.: 09/195,230

[22] Filed: Nov. 18, 1998

[30] Foreign Application Priority Data

Nov. 25, 1997 [DE] Germany ..... 297 20 862

[51] Int. Cl.[6] ..... H01H 2/14

[52] U.S. Cl. ..... 200/534; 200/540

[58] Field of Search ..... 200/534, 538, 200/540, 542, 43.07, 43.04, 243, 520–552

[56] References Cited

U.S. PATENT DOCUMENTS 3,699,276 10/1972 Atakkaan ..... 200/16 A 5,359,163 10/1994 Woodard ..... 200/249

*Primary Examiner*—Michael L. Gellner

*Assistant Examiner*—Nhung Nguyen

*Attorney, Agent, or Firm*—Barnes & Thornburg

[57] ABSTRACT

A safety switch including a spring-loaded tappet axially displaceably disposed in a switch cover; a switching bridge on the tappet; and an actuator above the tappet. An essentially U-shaped element has a center web and a first and second leg. The element is swivellably disposed in the cover in the area of the center web and the first leg of the element engages the tappet. The second leg is situated above the tappet such that when the actuator has moved in, the second leg reaches behind and engages the actuator in a switch-on position and permits a complete pulling-out of the actuator from the cover only in a switch-off position.

13 Claims, 2 Drawing Sheets

SAFETY SWITCH

BACKGROUND AND SUMMARY OF THE INVENTION

The present invention relates to a safety switch having a spring-loaded tappet which is axially displaceably disposed in a switch cover, which is equipped with a switching bridge and which, at one of its ends, has an actuating device in the form of a switch jack which is situated in the area of an insertion opening for a bow-type actuator and interacts with the actuator in such a fashion that the tappet—and thus also the switching bridge—when the actuator is moved in, is displaced in the switch-on position and, when the actuator is pulled out, is displaced in the switch-off position.

Safety switches of the above-mentioned type are known per se.

Among others, it is required for safety switches of this type that, as the actuator is pulled out of the switch cover, the tappet and therefore the switching bridge connected with the tappet is displaced in the switch-off position. Thus, it is ensured in every case that, when the actuator is pulled out, the switch-off position will also exist if the springs, which normally load the tappet in the switch-off position, were damaged and are therefore not operable.

It is an object of the present invention to design a safety switch of the initially mentioned type such that the above-mentioned requirement can be met by particularly simple constructive devices.

According to the invention, the safety switch's switch jack consists of an essentially U-shaped element which, in the area of its center web, is swivellably or pivotally disposed in the cover and, a first leg engages the tappet and a second leg is situated above the tappet. The second leg, when the actuator is moved in, reaches behind this actuator and permits a complete pulling-out of the actuator from the cover only in the switch-off position.

The second leg of the U-shaped element may (a) engage the tappet in a recess in the tappet or (b) be pivotally connected to the tappet. Both solutions have in common that the switch jack has a particularly simple design in the form of a U-shaped element. Such shapes can be manufactured at reasonable cost without any problem and reliably meet the requirement of ensuring that, when the actuator is pulled out, the switch-off position of the tappet and switching bridge will be in every case. In the first-mentioned solution, the second leg of the switch jack, engaging in the recess of the tappet, displaces the tappet in the switch-off position direction also when the springs loading the tappet are damaged or destroyed. Only when the tappet is in the switch-off position, can the actuator then be completely removed from the switch cover. In the second solution, it is ensured by the connection between the switch jack and the tappet itself that when moving out of the switch-on position, the tappet is in every case first moved into the switch-off position when the actuator is pulled out of the cover. In this case also, the tappet is necessarily taken along also when the springs loading the tappet are damaged or destroyed. This forced taking-along takes place as in the first case by the first leg of the switch jack which reaches behind the actuator. This contact is not eliminated before the tappet is in the switch-off position.

A detent is provided within the cover and mechanically fixes the tappet in the switch-off position. The detent may be between the cover and the tappet. The detent may also be between the U-shaped element and the tappet to maintain the first leg of U-shaped element out of the path of the actuator in the switch-off position.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 3:
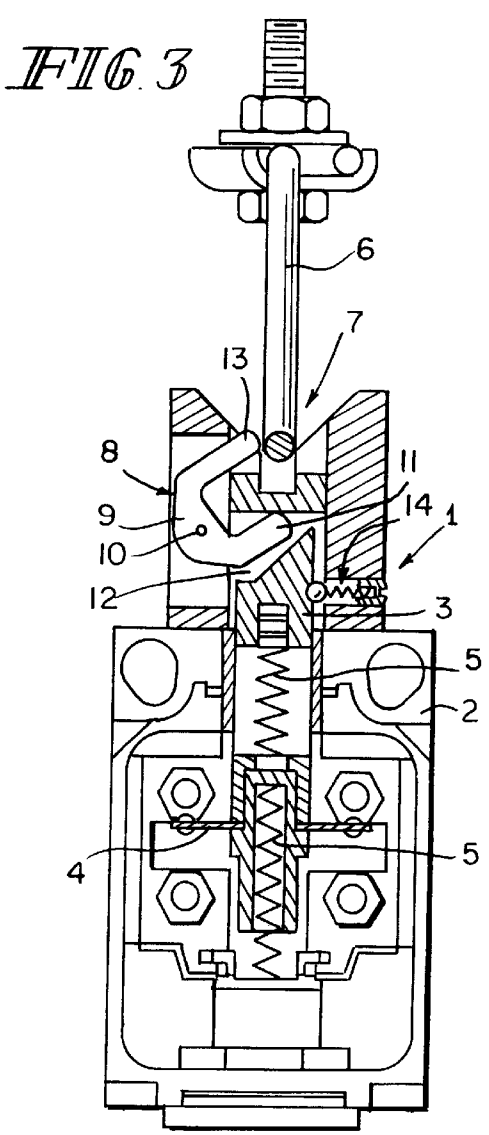
FIG. 3 is a sectional view corresponding to FIGS. 1 and 2 of the safety switch according to the invention in a position in which the actuator is almost completely pulled out of the switch cover.

In the embodiments, reference number 1 in each case indicates a safety switch as a whole which, within a switch cover 2, is provided with a tappet 3 which carries a switching bridge 4. The tappet 3 is loaded in the axial direction by springs 5, specifically such that, by means of these springs 5, the tappet 3 is constantly loaded in the move-out direction indicated by the arrow A in FIGS. 1 and 4.

Figure 1:
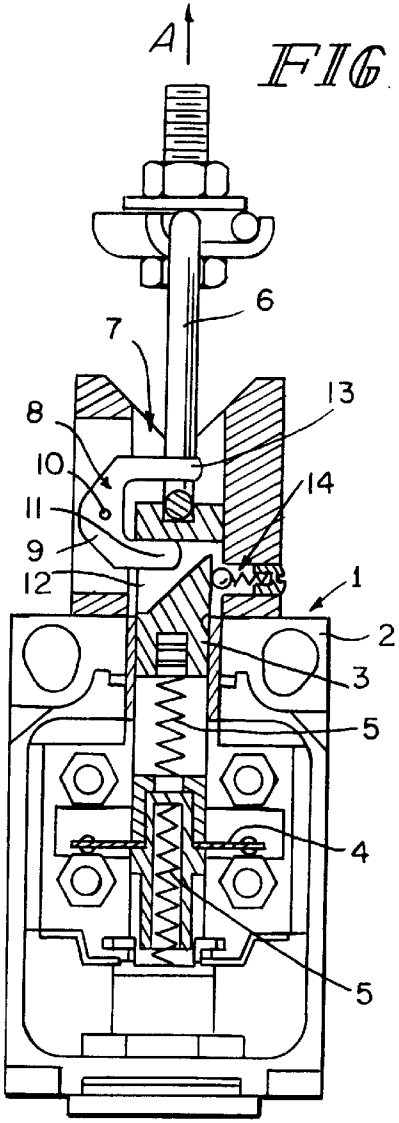
FIG. 1 is a sectional view of a safety switch according to the invention in the switch-on position.
Figure 4:
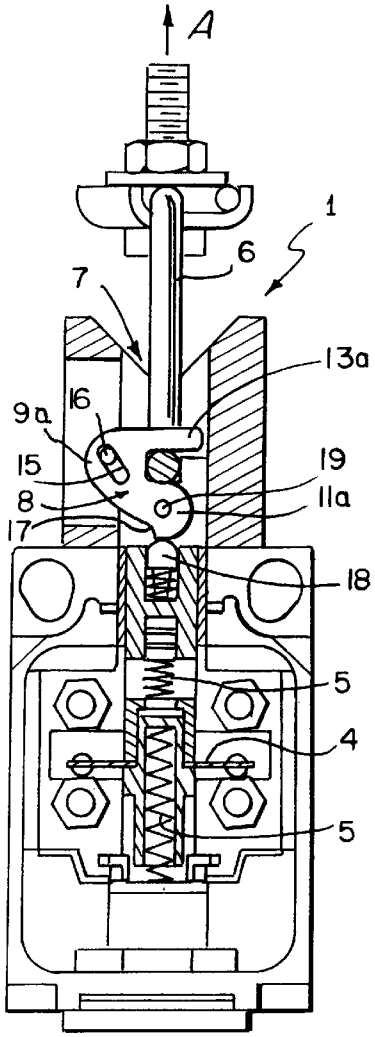
FIG. 4 is a sectional view corresponding to FIG. 1 of a safety switch according to another embodiment of the invention.

In FIGS. 1 and 4, the tappet 3 is in each case displaced in the switch-on direction into the switch cover 2 by a bow-type actuator 6 which can be inserted through an insertion opening 7 into the switch cover 2 and which presses on the tappet 3 against the effect of the spring 5.

In both embodiments, an actuating device in the form of a switch jack 8, which interacts with the actuator 6, is provided in the area of the above-mentioned insertion opening 7.

Figure 2:
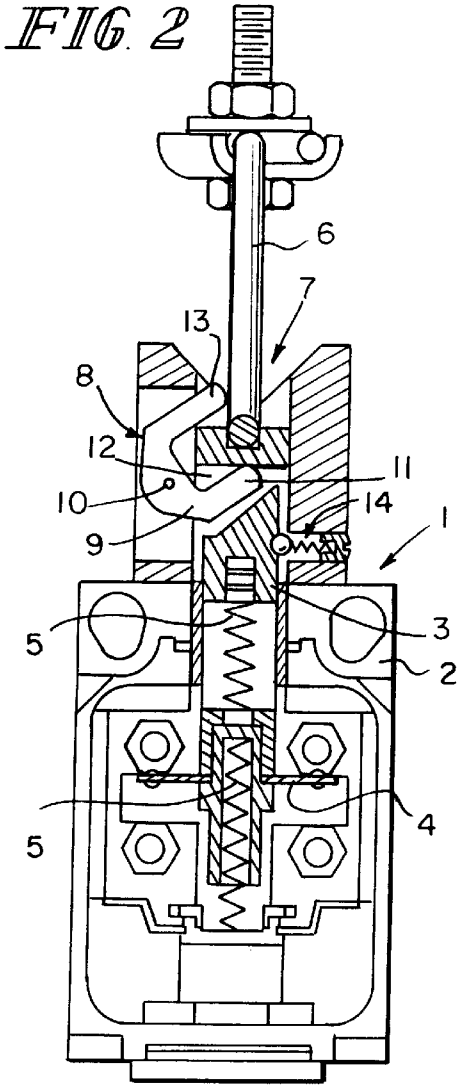
FIG. 2 is a sectional view corresponding to FIG. 1 of the safety switch in the switched-off condition while the actuator is slightly inserted into the switch cover.

In the embodiments according to FIGS. 1 to 3, the switch jack 8 is constructed as an approximately U-shaped element which, in the area of its center web 9, is swivellably or pivotally disposed in the cover 2. For this purpose, a pin 10 is provided which is fixed in the cover 2 and penetrates a hole in the center web 9.

One of the side legs 11 of the U-shaped element engages in a recess 12 of the tappet 3.

The second side leg 13 of the U-shaped element reaches behind the moved-in actuator 6 as soon as actuator 6 has moved into the switch cover 2 and has actuated the tappet 3.

This above-described position is illustrated in FIG. 1. If now the actuator 6 is moved from this position in the direction of the arrow A, the tappet 3 is necessarily moved in the same direction, by the springs 5 and also by the side leg 11 of the U-shaped element engaging the recess 12 of the tappet 3, so that the whole safety switch 1 is brought into the switch-off position.

Since there is a forced take-along connection between the switch jack 8 and the tappet 3, and furthermore, a swivelling of the switch jack takes place by the moving-out actuator 6, a displacement of the tappet 3 would also be carried out if the springs 5 were completely destroyed.

FIGS. 2 and 3 show the positions which correspond to the switch-off position. FIG. 2 indicates the position of the actuator 6 which occurs when this actuator 6 is inserted into the insertion opening 7 of the switch cover 2 and strikes against the tappet 3. FIG. 3 shows the position of the actuator 6 which occurs shortly before the final pulling of the actuator 6 out of the cover 2. FIGS. 2 and 3 show very clearly that, in the switch-off position, the bow-type actuator 6 can be moved past the second side leg 13 of the switch jack without being impaired. As soon as the switch jack 8 is pivoted by a further pushing-in of the actuator 6 in the direction of the position according to FIG. 1, the side leg 13 of the U-shaped element will reach behind the actuator 6 so that, during the subsequent pulling-out of the actuator 6, a reverse swivelling of the U-shaped element will occur with the simultaneous taking-along of the tappet 3 in the switch-off position.

FIGS. 1 to 3 show that a ball lock or detent 14 is provided in the area of the switch cover 2. The position of the tappet 3 is mechanically fixed in the switch-off position by the ball lock 14. This increases the safety of the whole switch concept because it is prevented, in the case of an inappropriate installation position of the safety switch 1, that the tappet 3 may be displaced by the force of gravity into a switch-on position when the springs 5 are destroyed or damaged.

Figure 6:
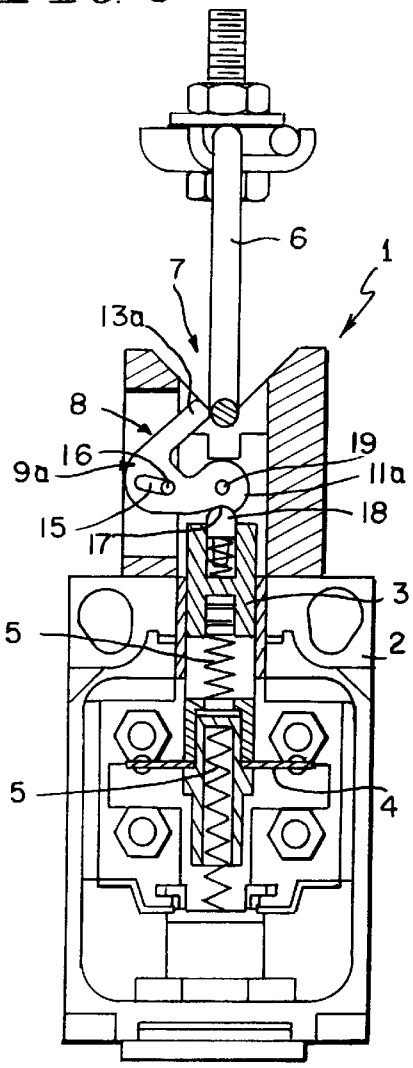
FIG. 6 is a sectional view corresponding to FIG. 3 of the safety switch according to FIGS. 4 and 5.
Figure 5:
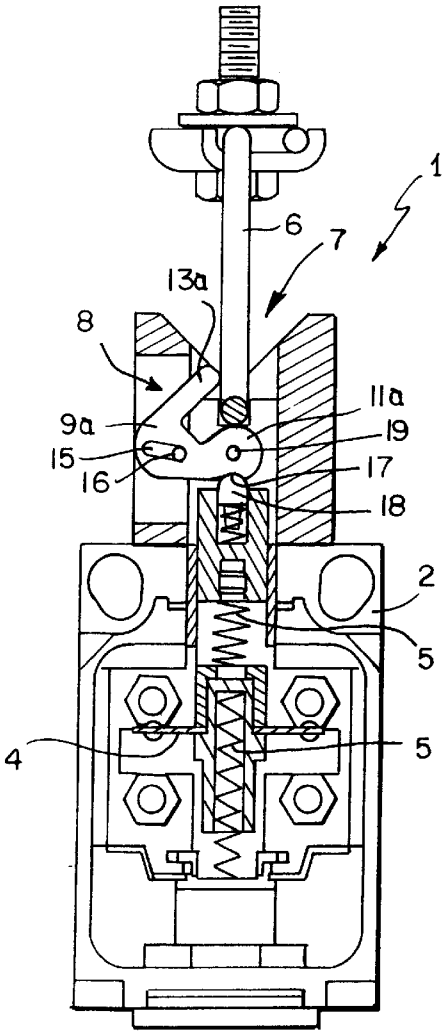
FIG. 5 is a sectional view corresponding to FIG. 2 of the safety switch according to FIG. 4.

The embodiment of the invention according to FIGS. 4 to 6 differs from the above-described embodiment of FIGS. 1–3 only in that here the switch jack 8, which is again constructed as an approximately U-shaped element, is pivoted at 19 in the area of one of its side legs 11*a* to the tappet 3, and in the area of its center web 9*a*, has an oblong hole 15 through which a pin 16 passes which is fixed in the switch cover 2. When the actuator 6 is pushed in, the second side leg 13*a* of the U-shaped element, as in the case of the embodiment according to FIGS. 1 to 3, reaches behind the above-mentioned actuator 6. This ensures that, when the actuator 6 is pulled out, the tappet 3 is also definitely moved out of its switch-on position according to FIG. 4 into a switch-off position according to FIGS. 5 and 6, even if the springs loading the tappet 3 are damaged or destroyed. Only after a sufficient swivelling of the switch jack 8 to the positions illustrated in FIGS. 5 and 6, can be actuator 6 be pulled completely out of the switch cover 2 or, when the tappet 3 is actuated again, can again be introduced into the switch cover.

A securing of the switch-off position illustrated in FIGS. 5 and 6, in the case of the embodiment shown there, occurs in that the side leg 11*a* is provided with a rounded detent recess 17 in which a spring-loaded detent cam 18 engages when the switch jack 8 as a whole is swivelled into the release position for the actuator 6 as illustrated in FIGS. 5 and 6.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A safety switch comprising:

a spring-loaded tappet axially displaceably disposed in a switch cover;

a switching bridge on the tappet;

an actuator above the tappet;

an essentially U-shaped element having a center web and a first an d second leg;

the element being swivellably disposed in the cover in the area of the center web;

the first leg of the element engages the tappet;

the second leg being leg situated above the tappet such that when the actuator has moved in, the second leg reaches behind and engages the actuator in a switch-on position and permits a complete pulling-out of the actuator from the cover only in a switch-off position.

2. A safety switch according to claim 1, wherein the first leg of the element engages the tappet in a recess of the tappet.

3. A safety switch according to claim 2, wherein the web includes a hole and a pin in the hole pivotally connects the web to the cover.

4. A safety switch according to claim 2, including a detent between the tappet and the cover mechanically fixing the tappet in the switch-off position.

5. A safety switch according to claim 1, wherein the first leg of the element is pivotally connected to the tappet.

6. A safety switch according to claim 5, wherein the web includes an oblong hole and a pin in the hole swivellably connects the web to the cover.

7. A safety switch according to claim 5, wherein the first leg of the element includes a detent recess and the tappet includes a detent which engages the recess as soon as the tappet has moved into the switch-off position.

8. A safety switch according to claim 1, wherein the web includes an oblong hole and a pin in the hole swivellalby connects the web to the housing.

9. A safety switch according to claim 8, wherein the first leg of the element includes a detent recess and the tappet includes a detent which engages the recess as soon as the tappet has moved into the switch-off position.

10. A safety switch according to claim 1, wherein the web includes a hole and a pin in the hole pivotally connects the web to the cover.

11. A safety switch according to claim 1, including a detent within the cover mechanically fixing the tappet in the switch-off position.

12. A safety switch according to claim 1, including a detent between the tappet and the cover mechanically fixing the tappet in the switch-off position.

13. A safety switch according to claim 1, wherein the first leg of the element includes a detent recess and the tappet includes a detent which engages the recess as soon as the tappet has moved into the switch-off position.

* * * * *